US006162573A

United States Patent [19]

Grande et al.

[11] Patent Number: 6,162,573

[45] Date of Patent: Dec. 19, 2000

[54] BLENDED CUSTOM COLOR TONERS AND DEVELOPERS

[75] Inventors: Michael L. Grande, Palmyra; Edward J. Gutman, Webster; James J. Franzen, Fairport, all of N.Y.

[73] Assignee: Xerox Corporation, Stamford, Conn.

[21] Appl. No.: 08/351,162

[22] Filed: Nov. 30, 1994

[51] Int. Cl.[7] ..... G03G 9/08

[52] U.S. Cl. ..... 430/137

[58] Field of Search ..... 430/106, 109, 430/137

[56] References Cited

U.S. PATENT DOCUMENTS

| | | | |
|---|---|---|---|
| 3,236,776 | 2/1966 | Tomanek | 430/109 |
| 4,312,932 | 1/1982 | Hauser et al. . | |
| 4,395,471 | 7/1983 | Hauser et al. . | |
| 4,859,560 | 8/1989 | Nakamura et al. | 430/137 |
| 5,032,483 | 7/1991 | Ichimura et al. | 430/106 |
| 5,077,158 | 12/1991 | Nakano | 430/106 |
| 5,204,208 | 4/1993 | Paine et al. . | |
| 5,370,962 | 12/1994 | Anderson et al. | 430/106 |

FOREIGN PATENT DOCUMENTS

| | | | |
|---|---|---|---|
| 63-058357 | 3/1988 | Japan | 430/106 |
| 63-144360 | 6/1988 | Japan | 430/106 |
| 1-159666 | 6/1989 | Japan | 430/106 |

OTHER PUBLICATIONS

Diamond, Arthur S. (1991) *Handbook of Imaging Materials.* New York: Marcel Dekker, Inc. p. 195.

*Primary Examiner*—Christopher D. RoDee
*Attorney, Agent, or Firm*—Oliff & Berridge, PLC; Eugene O. Palazzo

[57] ABSTRACT

A process for producing a color toner or developer composition includes selecting at least two different color toners, in the form of toner pellets, mixing the color toner pellets to form a mixture, and grinding the color toner pellets to produce a final powdered toner composition of a specific customer selectable color. The powdered color toner composition may then be mixed with additional additives and/or developer carrier particles to produce a developer composition.

12 Claims, No Drawings

BLENDED CUSTOM COLOR TONERS AND DEVELOPERS

BACKGROUND OF THE INVENTION

This invention relates to an improved process for producing toners and developers of specific, customer selectable colors. More particularly, this invention relates to a process whereby color pellets of the toners are blended prior to the grinding of the pellets and mixing of the ground toner powders into a final toner or developer composition. Such process is particularly useful in the production of toners and developers for use in single-pass electrostatographic imaging systems.

Conventional toners, resins and methods for producing such toners and resins are well known in the art.

Several methods of producing blended color toners and developers are also known in the art. For example, U.S. Pat. No. 4,312,932 discloses toners and developers wherein the developing composition comprises a single carrier and resin particles containing up to four pigments. The process involves incorporating multiple appropriate pigments into the resin, for example, by blending the pigments together in the molten resin during the processing and preparation of the resin, to yield a toner or developer with the desired specific color. As a further example, U.S. Pat. No. 4,395,471 describes a process whereby three separately prepared color toners are mixed in an appropriate ratio to yield a final toner composition of a desired specific color. In that process, previously-prepared yellow, cyan, and/or magenta toners are mixed together in their powdered or ground form and then combined with a single carrier to yield a developer with a specific customer selectable color. A similar process is also disclosed in U.S. Pat. No. 5,204,208, which describes forming a custom color toner by mixing together specified amounts of at least two encapsulated toners of different colors.

Conventional methods for producing color toners possess several disadvantages. These include difficulties in the handling and storage of the toner powders and the diseconomies of scale in producing small batches of specific customer selectable color toners. For example, if the color toner is produced by the method of incorporating the colorants directly into the resin, it is very uneconomical to produce small batches of such color toners. Further, where the color toner is produced by a method wherein the component toners and/or colorants are utilized in a powdered form, it is more difficult to handle and store the powdered compositions. Furthermore, it is sometimes difficult to ensure that blending of the powders results in a homogeneous toner composition, resulting in a toner with poor or inconsistent print qualities.

SUMMARY OF THE INVENTION

A need continues to exist for improved color toner compositions. Specifically, the need exists for an economical and feasible process whereby toners and developers of a specific customer selectable color may be produced on either a small or a large scale. The need also exists for a method of producing such color toners and developers whose color composition is more certainly homogeneous throughout the toner or developer composition. Such improved color toner and developer compositions, and a method for their production, are provided in this invention.

Specifically, this invention provides a process for producing a color toner or developer composition, comprising grinding a mixture of pellets of at least two color toners to form a final powdered color toner composition.

The toner and developer compositions of the present invention are particularly useful in electrostatographic development systems. Particularly, the toners and developers of the present invention are useful in single-pass electrostatographic imaging and printing systems.

Distinct features of the present invention are that the specifically desired customer selectable color is not incorporated directly into a single resin. Further, separate base color toner compositions are mixed in pellet rather than powder form to create a toner of a different, customer selectable color. In this invention, a base set of color toners are produced, but are maintained and stored in pellet form for eventual mixing rather than being ground into a final powdered toner. These toner pellets are then mixed in desired proportions, either prior to or during the grinding process, to produce a homogeneous final color toner composition.

Embodiments of the present invention overcome disadvantages of conventional processes. Storage and handling of materials are improved, as pellets are more easily handled and stored than are powders. Mixing of the color toners in pellet rather than powder form produces a more homogeneous mixture, thereby improving the color characteristics of the toners and developers produced thereby. Furthermore, diseconomies of scale in producing small batches of specific colors are overcome because a small number of base color toners, such as red, blue, green and the three subtractive primary colors, may be separately and conveniently stored in their pellet form, and then mixed in appropriate quantities and ratios as needed and then ground to form a broad spectrum of specific customer selectable color toners. The process of the present invention also decreases the turnaround time between batches of producing color toners because less equipment needs cleaning between the batches.

DETAILED DESCRIPTION OF PREFERRED EMBODIMENTS

The present invention may be used to produce color toners and developers.

The process of the present invention generally comprises mixing two or more color toners, in pellet form and in appropriate ratios, and grinding the mixture, to produce a final toner composition of a desired specific customer selectable color. As starting toner pellet compositions may be used any conventional color toners, such as those prepared in an extruding process, which have not been ground into a final toner powder.

The starting toner composition of the present invention may comprise any suitable resins, with or without other internal or external additives.

As resin materials, toner compositions of the present invention may utilize any of the numerous suitable resins such as thermoplastic resins known in the art to be useful in producing toners and developers. Suitable resins that may be utilized in the present invention include but are not limited to olefin polymers such as polyethylene, polypropylene and the like; polymers derived from dienes such as polybutadiene, polyisobutylene, polychloroprene and the like; vinyl and vinylidene polymers such as polystyrene, styrene butyl methacrylate copolymers, styrene butylacrylate copolymers, styreneacrylonitrile copolymers, acrylonitrile-butadiene styrene terpolymers, polymethylmethacrylate, polyacrylate, polyvinyl alcohol, polyvinyl chloride, polyvinyl carbazole, polyvinyl ethers, polyvinyl ketones and the like; fluorocarbon polymers such as polytetrafluoroethylene, polyvinylidene fluoride and the like; heterochain thermoplastics such as polyamides, polyesters, polyurethanes, polypeptides, casein, polyglycols, polysulfides, polycarbonates and the like; and cellulosic copolymers such as regenerated cellulone, cellulose acetate, cellulose nitrate and the like; and mixtures thereof. Of the vinyl polymers, resins containing a relatively high percentage of styrene are preferred, such as homopolymers of styrene or styrene homologs of copolymers of styrene. One preferred resin used in the present invention is a copolymer resin of styrene and n-butylmethacrylate. Another preferred resin used in the present invention is a styrene butadiene copolymer resin with a styrene content of from about 70% to about 95% by weight, such as PLIOTONE™ available from Goodyear Chemical.

The resins are generally present in the toners of the present invention in an amount of from about 40% to about 98% by weight, and more preferably from about 70% to about 98% by weight; although they may be present in greater or lesser amounts, provided that the objectives of the present invention are achieved. For example, toner resins of the present invention can be subsequently melt-blended or otherwise mixed with charge control additives, surfactants, emulsifiers, pigment dispersants, flow additives and the like. The resultant product can then be processed into pellets by known methods such as extrusion. The toner pellets preferably have an average volume particle diameter of from about 5 mm to about 6 mm. However, smaller or larger sized pellets and/or particles are not meant to be excluded from the process of the present invention, it being understood that the acceptable range of pellet sizes is dependent upon the design of the particular grinder being used to grind the pellet mixture into a final powdered toner composition.

Various suitable colorants can be employed in toners of the present invention, including suitable colored pigments, dyes, and mixtures thereof. Suitable colorants include, but are not limited to, Carbon Black, such as Regal 330® carbon black (Cabot), Acetylene Black, Lamp Black, Aniline Black, Chrome Yellow, Zinc Yellow, Sicofast Yellow, Luna Yellow, Novaperm Yellow, Chrome Orange, Bayplast Orange, Cadmium Red, Lithol Scarlet, Hostaperm Red, Fanal Pink, Hostaperm Pink, Lithol Red, Rhodamine Lake B, Brilliant Carmine, Heliogen Blue, Hostaperm Blue, Neopan Blue, PV Fast Blue, Heliogen Green, Cinquassi Green, Hostaperm Green, Hostaperm EB, titanium dioxide, cobalt, nickel, iron powder, various barium, calcium, and strontium salts, Sicopur 4068 FF, and iron oxides such as Mapico Black (Columbia), NP608 and NP604 (Northern Pigment), Bayferrox 8610 (Bayer), MO8699 (Mobay), TMB-100 (Magnox), mixtures thereof and the like.

The colorant is incorporated into the toner in an amount sufficient to impart the desired color to the toner. The percentage of colorant mixture present in the toner composition can vary depending on many factors including the shade of color desired. For example, from about 1 % to about 20% by total weight and preferably from about 5% to about 12% by weight of colorant may be present. Thus, in this example, from about 80% to about 99%, and preferably from about 88% to about 95% by weight of resin may be present. As another example, wnere a black colorant is a substantial component of the colorant mixture, the percentage of colorant mixture in the toner may range from about 5% to about 60% by weight of resin.

Various known suitable effective positive or negative charge enhancing additives can be selected for incorporation into the toner compositions of the present invention, preferably in an amount of from about 0.1% to about 10% by weight, and more preferably from about 1% to about 3% by weight. Examples include quaternary ammonium compounds inclusive of alkyl pyridinium halides; alkyl pyridinium compounds, as disclosed in U.S. Pat. No. 4,298,672, the disclosure of which is totally incorporated herein by reference; organic sulfate and sulfonate compositions, as disclosed in U.S. Pat. No. 4,338,390, the disclosure of which is totally incorporated herein by reference; cetyl pyridinium tetrafluoroborates; distearyl dimethyl ammonium methyl sulfate; zinc and aluminum salts such as Bontron E84™ or E88™, respectively, available from Orient Chemical Co.; and the like.

Additionally, other internal and/or external additives may be added in known amounts for their known functions.

It is not necessary that the component toner pellets that are mixed and ground be comprised of the same resin and/or additives. Indeed, the present invention permits multiple toner pellets of different colorant, resin, and additive compositions to be mixed and ground to yield a different, homogeneously mixed color toner powder.

Whereas prior art methods complete the process of separately preparing different color toner particles by grinding the toner pellets, this step need not be immediately conducted in the present invention. Rather, the toner pellets may be stored for eventual final processing into the specifically desired customer selectable color toner. Storage and further handling and processing of the toner pellets are much more convenient than similar processing of the powdered toners. Furthermore, mixing of the toners in their pellet form has been found in embodiments to have the unexpected result of achieving a more homogeneous colorant mixture in the final toner.

Although the numerous colorants as described above may be combined in a resin binder to yield a single toner with the desired color, such selection is not conducive to small scale production of specific colors. Instead, the present invention allows for the production of several toners having base colors, such as white, black, red, blue, green and the three subtractive primary colors cyan, magenta and yellow, which may be stored and later mixed and ground in appropriate proportions to yield a specific customer selectable color toner. As such, the present invention is much more applicable to small scale production of specific customer selectable color toners.

Although the process of the present invention is not particularly limited to toner pellets of any specific size, the color toner pellets may, for example, be in the range of from about 5 mm to about 6 mm in volume average diameter; however, smaller and larger sized pellets and particles may be used in the process of the present invention. The pellet size will vary, depending on such factors as the specific toner composition and processing equipment (such as the specific extruder, mixer, grinder, etc. used in the process).

The final color toner composition is created by mixing, in the correct proportions, and then grinding the mixture of two or more of the starting color toner pellets, such as those identified above. Because the methods and processing equipment for mixing and grinding the toner pellets are known in the art, they will not be described in further detail herein. However, as examples of grinding apparatus that may be used in the process of the present invention, may be mentioned various fluid energy mills known in the art. For example, fluidized bed jet mills, pancake mills and micronizers may be used to grind the toner pellet mixture into the final powdered toner composition. Among the various fluidized bed jet mills that may be used in the present invention are the Condux CGS50 grinder, and the Alpine fluidized bed grinders such as the AFG-800, AFG-400, AFG-200, and AFG-100 models available from Hosokawa Micron International. Similarly, an example of the pancake mills include the Sturtyvent 15 inch grinder, and an example of acceptable micronizers is the AFG fringer.

Procedures and criteria for selecting specific colors, and for determining the proportions in which the colors are mixed, are known to those skilled in the art or can be determined by routine computation or routine experimentation. For example, a set of base color toner pellets corresponding to the colors red, blue and green and the three subtractive primary colors, cyan, magenta and yellow may be mixed and ground to form a wide variety of colors. The proportion of constituent color toner pellets can vary substantially, such proportions depending on the final customer selectable color desired. For example, as shown in Example 1 below, mixing and grinding equal proportions of red and blue color toner pellets yields a brown color toner composition. Similarly, mixing and grinding cyan color toner pellets with magenta color toner pellets in various proportions yields a final toner composition with varying hues of blue, purple and violet, depending on the ratio of color toner pellets being blended. Similarly, as a further example, magenta and red color toner pellets may be mixed and ground in various proportions to yield varying hues of red in a final toner composition.

Additionally, while there is no real preference as to the use of the colors red, green and blue, or to the amounts of colorants used, illustrative examples are provided in Table 1. For example, as shown in Table 1, mixing and grinding equal proportions of green and blue color pellets yields a teal blue color toner composition.

TABLE 1

Color Combinations Using Red, Green and Blue

| Approximate Desired Color Shade | Parts of Red By Weight | Parts of Green By Weight | Parts of Blue By Weight |
|---|---|---|---|
| Brown | 1 | 1 | |
| Purple | 1 | | 1 |
| Teal | | 1 | 1 |
| Olive | 1 | 2 | |
| Brown-Red | 2 | 1 | |
| Maroon | 2 | | 1 |

Furthermore, the set of base color toner pellets used to formulate the specific final color toner compositions of the present invention may include black, white and/or clear color toner pellets. The black color toner pellets may be mixed with the other color toner pellets to provide a darker final toner composition. Similarly, the white or clear color toner pellets may be mixed with the other color toner pellets to create a paler final color toner composition, without the use of halftones or tints that are often required in many color copying and printing processes and applications. Additionally, the black and white color toner pellets may be separately mixed and ground to provide final toner compositions having varying shades of gray.

Thus, the color toner pellets of the present invention are themselves mixed together prior to being ground into a final toner composition or processed into a developer composition. In one embodiment of the present invention, the pellets of the various color toners are mixed in the correct proportions in a mixing device such as a barrel tumbler for a period of time sufficient to ensure homogeneous mixing. The toner pellet mixture is thereafter fed into a grinding device and ground to particle sizes appropriate for application as a toner or developer composition.

In another embodiment of the present invention, the various color toner pellets are separately fed directly into a grinding device in the correct proportion to produce the desired end color. By the mixing action of the grinder, the separate color toner pellets are both ground and mixed together to form a homogeneous powdered mixture. Further embodiments, by modifying the embodiments specifically disclosed herein, will be apparent to those skilled in the art.

A powdered color toner obtained as outlined above may be processed by any of various methods known in the art to form a final toner or developer composition. Such processing may include classification of the toner powder by particle sizes, blending of the color toner powder with other additives to form a toner and/or a developer; and screening and packaging the final toner or developer products. For example, the powdered color toner obtained by the process of the present invention may subsequently be classified to enable toner particles with a preferred volume average diameter, for example, of from about 4 to about 25 microns, and more preferably from about 5 to about 12 microns. Examples of apparatus for such classification include the Donaldson AccuCut Model B18 and the Nisshin Turbo Classifier TCS25. Similarly, examples of apparatus for the powder additive blending operation include the 50 L and 130 L Littleford blender and the 75 L Henschel Vertical Mixer.

The resulting toner particles optionally can be formulated into a developer composition by mixing with carrier particles. Illustrative examples of carrier particles that can be selected for mixing with the toner composition prepared in accordance with the present invention include those particles that are capable of triboelectrically obtaining a charge of opposite polarity to that of the toner particles. Accordingly, in one embodiment, the carrier particles may be selected so as to be of a negative polarity in order that toner particles that are positively charged will adhere to and surround the carrier particles. Illustrative examples of such carrier particles include granular zircon, granular silicon, glass, steel, nickel, iron, ferrites, silicon dioxide, and the like. Additionally, there can be selected as carrier particles nickel berry carriers as disclosed in U.S. Pat. No. 3,847,604, the entire disclosure of which is totally incorporated herein by reference, comprised of nodular carrier beads of nickel, characterized by surfaces of reoccurring recesses and protrusions thereby providing particles with a relatively large external area. Other carriers are disclosed in U.S. Pat. Nos. 4,937,166 and 4,935,326, the disclosures of which are totally incorporated herein by reference.

The selected carrier particles can be used with or without a coating, the coating generally being comprised of fluoropolymers, such as polyvinylidene fluoride resins; terpolymers of styrene, methyl methacrylate, and a silane, such as triethoxy silane; tetrafluoroethylenes; other known coatings and the like.

The diameter of the carrier particles is generally from about 50 microns to about 1,000 microns, preferably about 200 microns, thus allowing these particles to possess sufficient density and inertia to avoid adherence to the electrostatic images during the development process. The carrier particles can be mixed with the toner particles in various suitable combinations. Preferably, the developer compositions of the present invention comprise from about 2% to about 7% by weight of toner and from about 93% to about 98% carrier particles. More preferably, the developer comprises from about 3% to about 5% toner.

Toners and developers of the present invention can be used in known electrostatographic imaging methods, including copying and printing systems. Thus for example, the toners or developers of the present invention can be charged, e.g., triboelectrically, and applied to an oppositely charged latent image on an imaging member such as a photoreceptor or ionographic receiver. The resultant toner image can then be transferred, either directly or via an intermediate transport member, to a support such as paper or a transparency sheet. The toner image can then be fused to the support by application of heat and/or pressure, for example with a heated fuser roll.

One skilled in the art will recognize that the above toner compositions and production method may be adjusted as necessary to achieve a toner with specific color characteristics. The invention will now be described in detail with reference to examples of specific preferred embodiments thereof, it being understood that these examples are intended to be illustrative only and the invention is not intended to be limited to the specific materials, conditions, process parameters, etc. recited herein. All parts and percentages are by weight unless otherwise indicated.

EXAMPLES

Conventional red and green toner pellets are produced by conventional methods of extruding resin, colorants and other additives through an extruder. The green toner pellets are prepared by adding to an extrusion device 92 percent by weight of suspension polymerized styrene butadiene copolymer resin particles (87/13), 7 percent by weight of the pigment Heliogen Green (available from BASF), and 1 percent by weight of the charge enhancing additive distearyl dimethyl ammonium methyl sulfate. The strands of product exiting from the extruder are cooled by immersion in a water bath maintained at room temperature, air dried and processed to form pellets having a volume average diameter of from 5 mm to 6 mm. Red toner pellets are prepared the same as the green toner pellets, except that the pigment is substituted with 6.7 percent by weight of Lithol Scarlet (available from BASF) and 0.6 percent by weight of Hostaperm Pink (available from Hoechst A.G.), which pigments are dispersed in 91.7 percent by weight of the same styrene butadiene copolymer resin. As with the green toner composition, the strands of product exiting from the extruder are cooled by immersion in a water bath maintained at room temperature, air dried and processed to form pellets having a volume average diameter of from 5 mm to 6 mm.

In a Beloit Model SDT barrel mixer are mixed equal portions of the red and green toner pellets. The toner pellets are mixed in the barrel mixer for thirty minutes, after which the mixture is transferred to a grinder. The mixture is ground to a particle size having a volume average diameter of about 13 $\mu$m, and then classified. The toner particles are then mixed in a ball mill with 0.3 percent by weight of AEROSIL™ R972 (available from Degussa Corp.) and 0.3 percent by weight of zinc stearate. Mixing is conducted for 30 minutes. The result is a powdered toner composition.

A developer is then produced by mixing, in a roll mill for 6n minutes, 3 parts by weight of the final color toner and 97 parts by weight of carrier particles. The carrier particles comprise a steel core coated with 0.8 percent by weight of a polymer mixture of 20 parts by weight carbon black and 80 parts by weight polymethyl methacrylate. The result is a developer composition that when used in an imaging apparatus, yields a chocolate brown color.

The developer composition thus produced is utilized in a fixing device, and 50,000 copies are run. At the conclusion of the test run, the toner exhibits excellent admix and machine performance, and the developer continues to operate well without a shift in color hue.

What is claimed is:

1. A process for producing a color toner or developer composition, comprising grinding a mixture of pellets of at least one color toner material and pellets of at least one other color toner material to form a final powdered color toner composition.

2. A process according to claim 1, wherein said pellets have a mean particle size of from about 5 mm to about 6 mm.

3. A process according to claim 1, wherein at least one of said color toner materials is selected from the group consisting of black and white toner materials.

4. A process according to claim 1, wherein said color toner materials are selected from the group consisting of red, blue, green, cyan, magenta and yellow color toner materials.

5. A process according to claim 1, wherein each of said color toner materials comprises a styrene/butadiene copolymer resin.

6. A process according to claim 1, wherein each of said color toner materials comprises a styrene/n-butyl methacrylate copolymer resin.

7. A process according to claim 1, wherein at least one of said color toner materials comprises a resin composition different from a resin composition of at least one other of said color toner materials.

8. A process according to claim 1, wherein said pellets are mixed while said grinding is being conducted.

9. A process according to claim 1, wherein said mixture of pellets is formed before said grinding is conducted.

10. A process according to claim 1, further comprising mixing the powdered color toner composition with developer carrier particles to produce a developer composition.

11. A process according to claim 10, wherein said toner composition is present in said developer composition in an amount of from about 2% to about 7% by weight.

12. A process according to claim 10, wherein said toner composition is present in said developer composition in an amount of from about 3% to about 5% by weight.

* * * * *